US007845377B2

(12) United States Patent
Edwards, Jr. et al.

(10) Patent No.: US 7,845,377 B2
(45) Date of Patent: Dec. 7, 2010

(54) COIN SEPARATOR TRAY FOR PURSE OR HANDBAG

(76) Inventors: Robert F. Edwards, Jr., 1957 Athens Dr., Conway, SC (US) 29526; Janet L. LaVeck, 1957 Athens Dr., Conway, SC (US) 29526

( * ) Notice: Subject to any disclaimer, the term of this patent is extended or adjusted under 35 U.S.C. 154(b) by 128 days.

(21) Appl. No.: 12/326,139

(22) Filed: Dec. 2, 2008

(65) Prior Publication Data

US 2010/0132857 A1 Jun. 3, 2010

(51) Int. Cl.
*B65D 83/10* (2006.01)

(52) U.S. Cl. ..... 150/152; 150/131; 150/150; 206/370; 206/366; 206/229; 206/317

(58) Field of Classification Search ..... 150/131, 150/150, 152; 206/370, 366, 229, 317
See application file for complete search history.

(56) References Cited

U.S. PATENT DOCUMENTS

| | | | | | |
|---|---|---|---|---|---|
| 1,541,564 | A | * | 6/1925 | Greer | 232/4 R |
| 1,581,985 | A | | 4/1926 | Sachs | |
| 1,803,441 | A | | 5/1931 | Sernacker | |
| 1,980,133 | A | | 11/1934 | Filipowicz | |
| 2,126,898 | A | | 8/1938 | Landis | |
| 2,130,502 | A | | 9/1938 | Lindemann | |
| 2,477,388 | A | | 7/1949 | Moore | |
| 2,797,719 | A | | 7/1957 | Hume | |
| 2,801,666 | A | * | 8/1957 | Steele | 150/113 |
| 2,868,254 | A | | 1/1959 | Saad | |
| 3,226,007 | A | * | 12/1965 | Thies et al. | 229/127 |
| 3,335,775 | A | * | 8/1967 | Adams | 150/113 |
| 4,756,406 | A | * | 7/1988 | Grounds | 206/8 |
| 4,969,554 | A | * | 11/1990 | Sawaya | 206/370 |
| 5,630,506 | A | * | 5/1997 | Thorne et al. | 206/366 |
| 5,782,280 | A | * | 7/1998 | Berry | 150/113 |
| 5,848,692 | A | * | 12/1998 | Thorne et al. | 206/366 |
| 5,894,975 | A | | 4/1999 | Holden et al. | |
| 6,070,628 | A | | 6/2000 | Nastasi | |
| 6,283,909 | B1 | * | 9/2001 | Sharp | 588/249.5 |
| 6,796,344 | B2 | | 9/2004 | Chen et al. | |
| 6,889,831 | B2 | * | 5/2005 | Pike | 206/366 |
| 7,325,681 | B2 | * | 2/2008 | Schonenbach | 206/317 |
| 7,591,388 | B2 | * | 9/2009 | Amormino | 220/229 |
| 7,624,777 | B2 | * | 12/2009 | Paller | 150/112 |
| 2002/0108828 | A1 | | 8/2002 | Soskin | |
| 2006/0027475 | A1 | | 2/2006 | Gleason et al. | |

* cited by examiner

*Primary Examiner*—Anthony Stashick
*Assistant Examiner*—Cynthia F Collado
(74) *Attorney, Agent, or Firm*—Bernhard P. Molldrem, Jr.

(57) ABSTRACT

A purse or handbag is provided with a coin separator tray to facilitate access to coins that have been dropped into the purse. The coin separator tray has an elongated pan dimensioned to match the length and width of the base of the purse or handbag, and is open at one end wall. A coin-separating cover fits onto the side walls of the pan. The cover has generally horizontal shelves that overlap to define a generally horizontal elongated coin slot. Any loose coins in the purse or handbag migrate to the base and pass through the coin slot into said pan. The coins can be dispensed by opening a flap at the base of the purse.

13 Claims, 3 Drawing Sheets

COIN SEPARATOR TRAY FOR PURSE OR HANDBAG

BACKGROUND OF THE INVENTION

This invention relates to improvements for ladies' purses, handbags, and pocket books, and is more particularly concerned with the problem of separating change, i.e., coins, from other items that may be in the purse. The invention is also directed to a coin-separating tray that is integrated with the bottom or base of the purse or handbag, and collects any coins that may migrate to the bottom of the purse, so that the person can easily access any coins and does not have to dig through the purse or handbag to scavenge any coins that may be there.

There is a problem concerning loose change that is completely unaddressed in any current design of women's purses or handbags. Currently, women may typically have to dig through their purses for change, i.e., coins, when making a purchase, or when leaving a tip or gratuity. Generally, coins that are received in change from a purchase are often just dropped into the purse, Then later, when making another purchase, the woman has to hunt through all the items in her purse to find the coins that are present. Often, this is time consuming and frustrating, especially when there are others in the check-out lane behind her (or behind him in some cases).

There have been earlier attempts to provide specially designed purses and handbags which have compartments on the inside or on the outside for keeping coins. However, these have not proven to be particularly convenient. Moreover, providing outside compartments on the purse or handbag affects the appearance and design of the article, which the user may find unattractive, thus deterring its use.

A number of purses, hand bags, and other hand-held carrying bags have been proposed with separate compartments and storage pockets for coins or other articles. Soskin Publication US 2002/0108828 shows a purse or handbag with a pull-out storage pocket that is accessible from the interior or from the exterior of the bag. Chen U.S. Pat. No. 6,796,344 shows a handbag with an interior or exterior removable enclosure. Holden et al. U.S. Pat. No. 5,894,975 is directed to a handbag or shoulder bag with zip-in interchangeable liners. Hume U.S. Pat. No. 2,797,719 shows a handbag with a built-in coin purse that is accessible from the outside of the handbag. Lindemann U.S. Pat. No. 2,130,502 shows a handbag with various compartments at the bottom of the handbag with flaps for accessing items such as cosmetics, but in Lindemann the compartments are separate from the main inside compartment of the purse or handbag. Landis U.S. Pat. No. 2,126,898; Filipowicz U.S. Pat. No. 1,980,133; Sernaker U.S. Pat. No. 1,803,441; and Sachs U.S. Pat. No. 1,581,985 show various handbags and pocketbooks with internal or external compartments for various items. Gleason et al. Publ. No. US 2006/0027475 relates to a tool bag which has one or more removable bottom trays. A number of storage volumes are defined by the various trays and the tool bag. However, none of the items shown or discussed in any of these references contains any feature that allows coins or similar articles that may gravitate to the bottom of the bag to separate themselves and fall into a lower compartment so they can be easily accessed, when needed.

Ladies' purses, handbags, and pocketbooks of the prior art, and for that matter tool bags of the prior art, have not concerned themselves with the problem of retrieving change, i.e., coins, that have been earlier dropped into the purse, and have not recognized a need for a means of segregation or separation of coins from other articles in a way that makes the coins easier to access and dispense.

OBJECTS AND SUMMARY OF THE INVENTION

Accordingly, it is an object of this invention to provide a design and arrangement for a purse or handbag that overcomes the drawbacks of the prior art.

It is another object to provide a coin separator tray or similar compartment for a purse or handbag that facilitates the access and dispensing of coins that had been earlier dropped into the purse as loose change.

It is a further object to provide a coin separator tray that allows any coins, i.e., non-ferrous metallic disks, that migrate to the base of the purse or handbag, to pass into the tray without allowing other objects in the purse or handbag to do so.

It is a still further object to provide the purse or handbag with a convenient door or flap at the base of the purse that allows coins that have collected in the coin separator tray to be poured out when needed, without adversely affecting the stylish design of the purse or handbag.

In accordance with one aspect of this invention, a coin separator tray is provided for use within a purse or handbag. As is typical, the purse or handbag has a base of a predetermined length and width. The purse has sides and ends, and a closure at the top, which can be a snap closure or zipper, for example, and carrying straps or handles. A more or less standard size purse may have a wider base, and can accommodate a wider tray. A more compact purse, for evening use, may be slimmer, and the base will accommodate a narrower tray.

The coin separator tray is formed of an elongated pan, and a coin separating cover. The elongated pan is dimensioned to match the length and width of the base of the purse or handbag, and has a bottom, side walls, and an end wall The pan is open at the end opposite the one end wall.

The coin separating cover is dimensioned to fit onto the side walls of the pan, and has a plurality of elongated, generally horizontal shelves. At least one of the shelves is spaced above another of the shelves to define a generally horizontal elongated coin slot. The coin slot is slightly wider than the thickness of the largest coin that it needs to accommodate, typically about 1/16 inch. Any coins in the purse or handbag that migrate to the base thereof can pass through the slot into the pan and are captured in the tray. The cover blocks other objects in the purse or handbag from passing into the pan. Preferably, the shelves extend along the length dimension of the pan parallel to the side walls. The cover has side rail portions that mate with the respective side walls of the pan, and there are side shelves that extend along them for the length of the rail portions in the length dimension of the pan. These shelves extend transversely towards one another partly across the width dimension of the pan, and a central shelf extends along the length dimension of the pan and above the two side shelves and overlapping them. This structure defines a pair of elongated coin slots. The cover also includes structure for holding the central shelf in place above the side shelves. In a preferred embodiment, the central shelf has an arcuate profile, such that coins that land on it will slide towards one or the other of the side shelves, and the side shelves are angled downward at the associated one of the coin slots, so that the coins will pass through the elongated coin slot and be captured in the pan. Also, the structure that holds the central shelf includes a plurality of transverse members extending between the two side rail members above the central shelf, and there are respective gussets or struts that each attach to the central shelf and to an associated one of the transverse members. Each of the transverse members may include a magnet, to help capture steel or iron objects, such as nail files or safety pins, but allow the non-ferrous coins to pass to the shelves and then through the coin slot.

For the standard size purse or hand bag, the coin separator cover has the two side shelves and the center shelf, as described above. However, for the slimmer evening purse or hand bag, the tray is constructed to be narrower, and has first and second side shelves that overlap one another at a position midway between the side walls to define a coin slot. Here, the first and second side shelves slope downward from the opposed side walls towards the coin slot, so that any coins naturally descend towards the slot and into the tray.

In any of these embodiments, the normal motion associated with carrying the purse or handbag will provide the motive force to allow the coins to migrate down and into the tray.

The tray can be made of a suitable durable plastic material, although the tray may be partly metal, if desired.

According to another aspect of the invention, a woman's purse or handbag, which typically is in the form of an enclosure made of at least a pair of sides, first and second end walls, and a base, is designed to accommodate the coin separator tray. The base of the purse has a predetermined length and width, and one of said end walls of the purse has a flap at the base which can be opened and closed. The coin separator tray as described above is positioned within the purse or handbag at its base.

The tray has an elongated pan dimensioned to match the length and width of the base of the purse or handbag, and, as aforesaid, has a bottom, and side walls, and is open at one end. The open end is positioned at the one of the end walls of the purse or handbag at which the flap closure is located. The tray also has a coin separating cover that is dimensioned to fit onto the side walls of the pan. The cover has a plurality of elongated generally horizontal shelves, arranged such that one of the shelves is spaced above and overlaps at least one other shelf, so as to define a generally horizontal elongated coin slot. The coins that are dropped into the purse or handbag migrate to the base of the purse or handbag. There, the coins pass through the slot into the pan. The structure of the cover keeps other objects in the purse or handbag from passing into the pan. The coins that are captured in this way can be accessed by opening the flap at the end of the purse, and then tipping the purse or handbag. The coins can be poured out the opening at the end of the purse, and the user does not have to dig through the articles in the purse to hunt for loose change.

In a favorable embodiment, the flap is hinged along a bottom edge, and there is a snap or other closure at an upper part. Favorably, there are accordion-fold members joining side edges thereof to the associated end wall of the purse of handbag. This structure keeps the coins from falling out the sides of the flap or closure.

The term coin as used here means small round disks of metal, usually non-ferrous metal, which are usually value items used in commercial exchange. This can include pennies, nickels, dimes, and quarters, and may include foreign coins, such as Canadian dollar coins or Euro coins. The term also is intended to encompass metal tokens and other similar items. The tray has horizontal shelves, with one shelf staggered above the other by slightly more than the thickness of the largest coin expected, e.g., a nickel (about 1/16 inch) or a dollar coin or Euro coin. The magnets on or above these shelves are intended to catch ferrous metal items such as pins, sunglasses, and nail files, but let the non-ferrous coins through. The coin tray can be lifted out of the purse when the user wants to clean her purse, or to put the tray into another purse of similar dimensions. Also, the tray cover is removable from the pan, to allow the pan to be cleaned out from time to time.

The above and many other objects, features, and advantages of this invention will become apparent to persons skilled in the art from the ensuing description of a preferred embodiment, which is to be read in conjunction with the accompanying Figures of Drawing.

DETAILED DESCRIPTION OF THE PREFERRED EMBODIMENT

Figure 1:
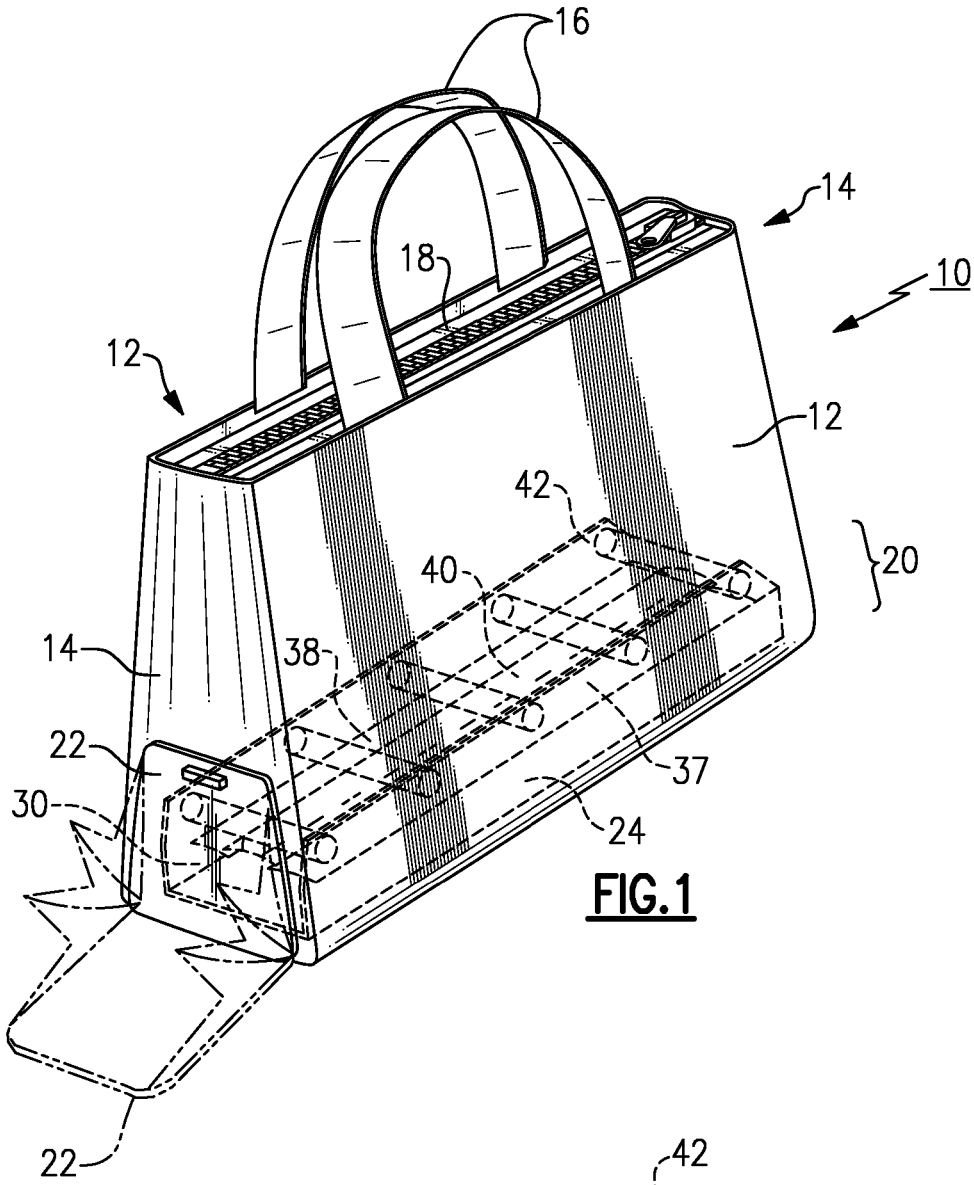
FIG. 1 is a perspective view, partly in broken line, showing a purse or handbag with a coin separator tray, according to one embodiment of this invention.

With reference to the Drawing, and initially to FIG. 1 thereof, a purse or handbag 10 according to an embodiment of this invention has a main compartment formed of front and rear side body panels 12, 12 and left and right end body panels 14, 14. At an upper end there are straps 16, which here are shown as handles, but which may comprise also a shoulder strap. A closure 18 closes the top of the purse or handbag 10. In the illustrated embodiment the closure is formed of a zipper but in may other versions, this may be snap closure, spring, clasp, or Velcro based closure. A base or bottom 20 of the purse or handbag has a predetermined width and a predetermined length. At one end, is an opening and a flap or door 22, which will be discussed shortly.

Figure 2:
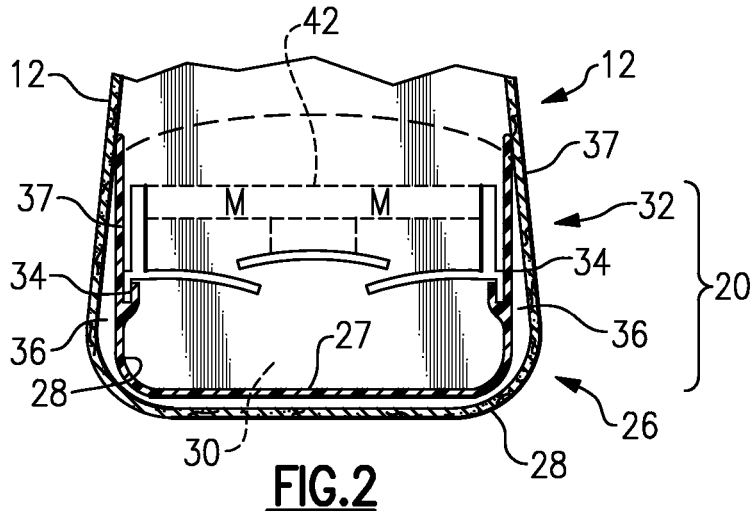
FIG. 2 is an end view of a base portion thereof.
Figure 3:
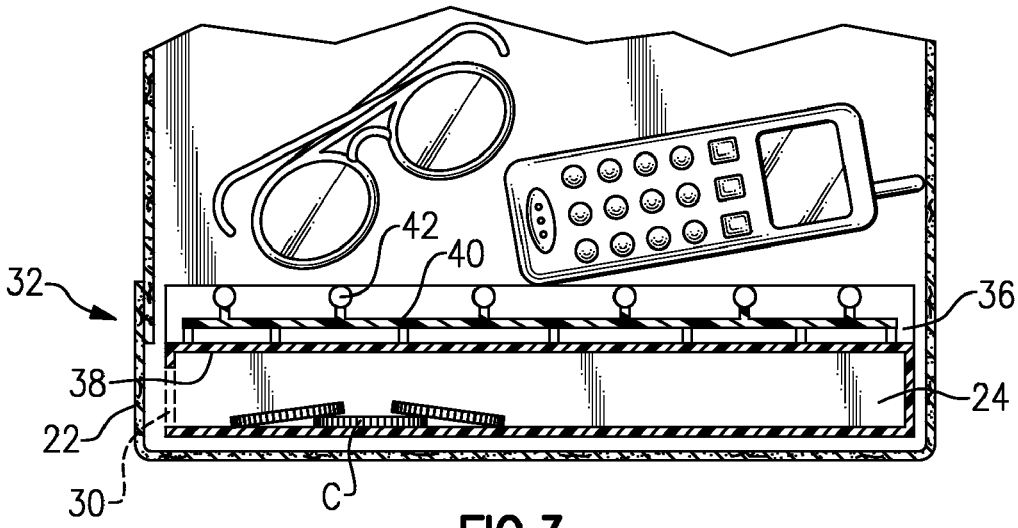
FIG. 3 is a side sectional view thereof.
Figure 4:
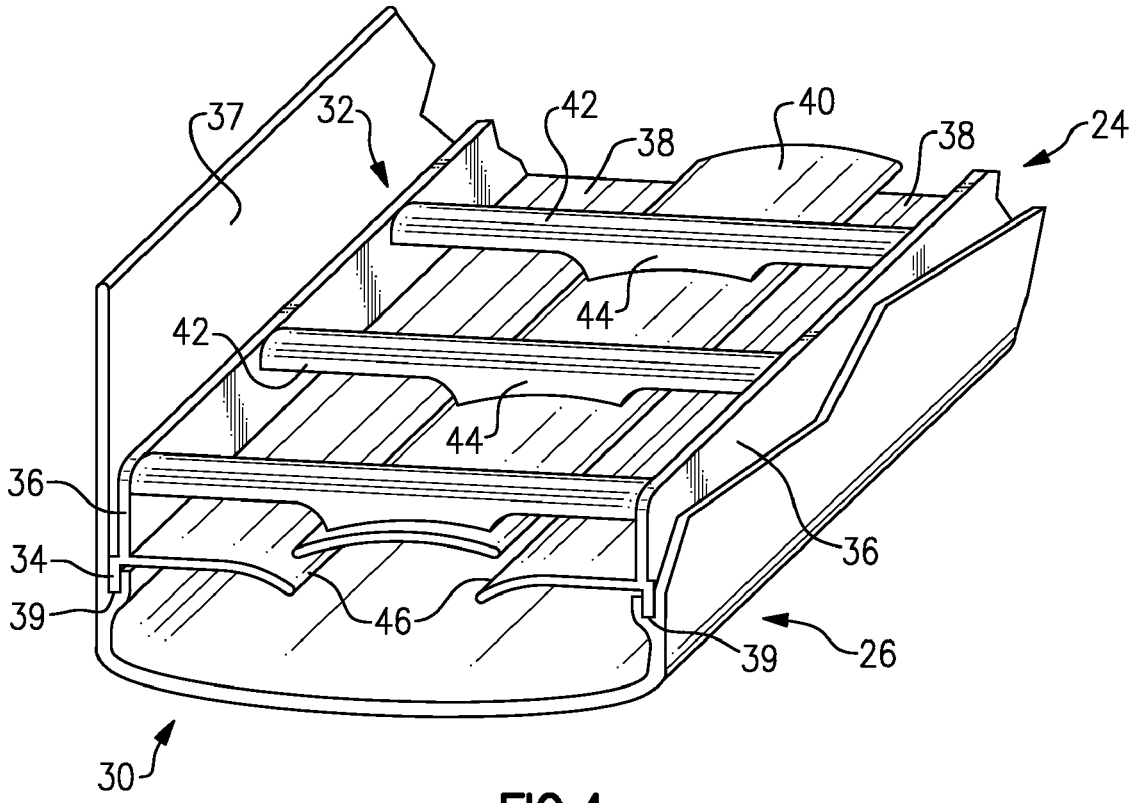
FIG. 4 is a perspective view of the coin separator tray of this embodiment.

A coin separator tray 24 is situated at the base 20 of the purse or handbag, as shown in broken line in FIG. 1 and as shown in more detail in FIGS. 2, 3, and 4. The tray 24 should fit snugly in the base 20 of the purse so that coins do not fall along its sides. In these views, the parts are shown with some spacing only for simplicity of illustration.

The coin separator tray 24 has generally the same width and length dimensions as the base 20 of the purse, so that it fits removably into the purse. The tray has a lower portion or pan 26 formed of a bottom 27 of the above predetermined width and length dimensions, with side walls 28 and one end wall, and with one open end 30 positioned at the location of the flap or door 22. An upper portion, or cover 32 has rail members 34 that extend along the sides and mate with the top rim of the side walls 28, and there are vertical side walls or flanges 36 that are attached to the rail members 34 and extend up from them. There are a pair of elongated side shelves 38 that extend along the rail members 34 and these side shelves 38 extend toward each other to define an open central area. A central shelf 40 extends the length of the cover and is spaced a short distance above the two side shelves 28 so that it overlaps them slightly. In this embodiment there are a number of transverse support bars 42 that extend between the two side walls of flange 36, and each of these support bars has a vertical gusset or strut 44 that attaches to the central shelf 40. In this embodiment, the support bars 42 each include a strong permanent magnet that is intended to attract any small ferrous metal objects, e.g., pins or paper clips, so that they do not fall into the coin separator tray 24.

As shown, the central shelf 40 is somewhat arcuate, and is bowed up at the center, while the side shelves 38 may also have a curved profile, and angle downward towards the center line of the pan 26. The central shelf 40 is offset above the side shelves 38 to define a pair of elongated coin slots 46. With the coin separator cover having the geometry as shown, any coins that may work themselves down to the cover 32 will slide off the curved central shelf 40 and down the angled side shelf 28 to one of the coin slots 46. The normal motion from carrying the purse or handbag will cause the coins (shown as C in FIG. 3) will pass themselves through the coin slot and come to rest in the pan 26.

As shown in FIG. 4, the sides of the tray may include walls 37 that extend up inside the handbag or purse. These side walls 37 facilitate permanent bonding of the tray to the bottom and sides of the handbag. The side walls 37 do not need to be very high, but should be high enough to facilitate removing of the separator cover 32. The walls 37 have a radiused edge and a sharp edge at the top. The wall 37 and the rail 34 form a recess 39 to receive an edge of the tray cover.

When the user needs to access the coins in the tray, she or he only needs to open the flap 22 to expose the opening 48 at the base of the purse and the open end 30 of the tray 24. Then, by tipping the purse or handbag, the coins can be dispensed, i.e., simply poured out.

Figure 5:
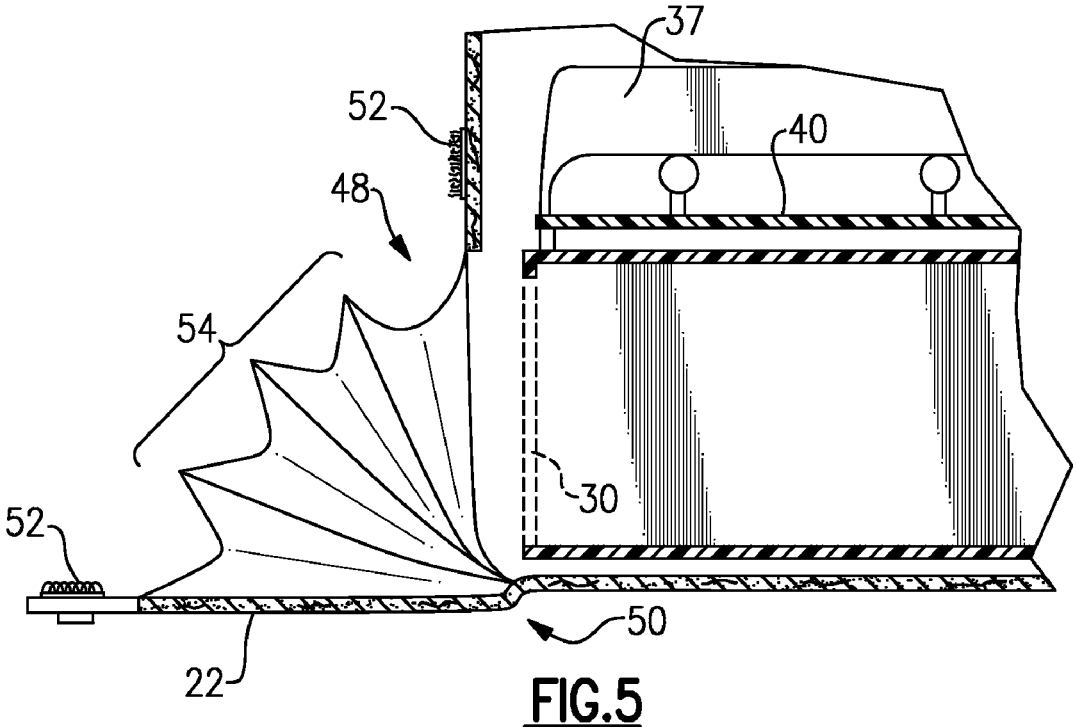
FIG. 5 is an side view of one end of the purse or handbag, showing the coin access door or flap.

FIG. 5 shows detail of the tray 24, and structure of the flap 22 or similar closure. The flap 22 has a hinge portion 50 along its lower edge where it joins to the base 20 of the purse, and a closure 52 that closes up the upper edge of the flap 22 to the side panel 14 above the opening 48. This closure may be a snap closure, Velcro, clasp, or other suitable closure device, sufficient to secure the flap 22 closed. Here a two-part closure 52 is shown. There are accordion-folded side walls 54 which join the sides of the flap 22 to the sides of the opening 48. These side walls prevent coins from falling off the side of the flap 22 when they are being dispensed.

Figure 6:
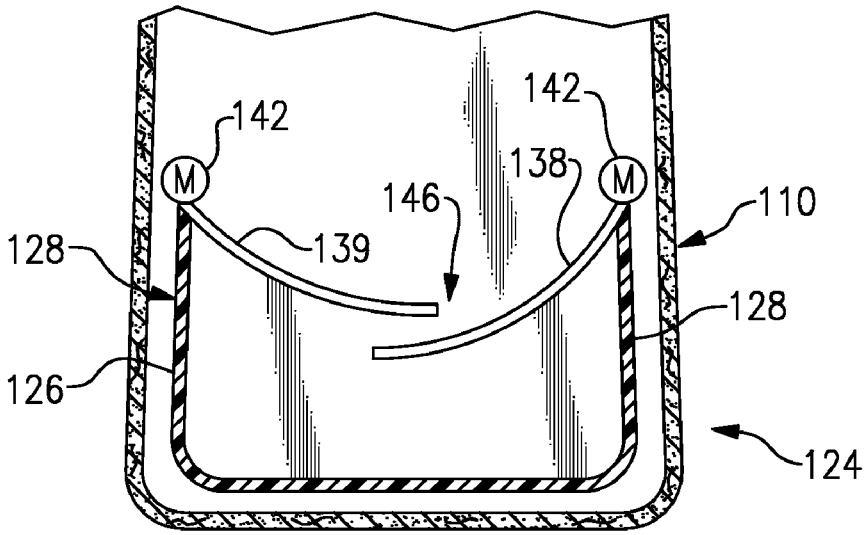
FIG. 6 is a cross sectional view of another embodiment.

FIG. 6 is a cross sectional view to illustrate another embodiment, i.e., a narrower coin selector tray 124 to be used in a purse 110 of slimmer dimensions, e.g., an evening bag. Here, the tray 124 has a narrow pan 126, with side walls 128, and with side shelves 138, 139 of arcuate profile and which slope downward towards the center of the tray 124. The shelves 138, 139 overlap one another and are spaced slightly apart so as to define an elongated horizontal coin slot 146. Magnetic members 142 may be positioned at the top edges of the tray 124 to pick up small ferromagnetic objects, such as paper clips, safety pins, or eyeglass frames so they do not fall into the tray. At the same time, coins that have been dropped into the purse will work themselves down into the base of the purse during normal motion of the purse being carried, and the coins will work themselves through the slot 146 and into the pan portion of the tray. From there, the coins can be dispensed or poured out, using the technique discussed above.

The separator can be used, in principle, for separating out flat items other than coins and tokens, e.g., flat metal parts, such as washers and nuts, as an industrial separation technique.

While the invention has been described in detail with respect to a preferred embodiment, it should be recognized that there are many alternative embodiments that would become apparent to persons of skill in the art. Many modifications and variations are possible which would not depart from the scope and spirit of this invention, as defined in the appended claims.

We claim:

1. Coin separator tray for a purse or handbag, wherein the purse or handbag has a base of a predetermined length and width; the coin separator tray comprising:

an elongated pan dimensioned to match the length and width of the base of the purse or handbag, and having a bottom, side walls, an end wall, and being open at another end opposite said end wall; and a coin separating cover dimensioned to fit onto the side walls of said pan, and including a plurality of elongated, generally horizontal shelves, wherein one of said shelves is spaced above and overlapping another of said shelves and held apart therefrom to define a generally horizontal elongated coin slot opening, such that any coins in the purse or handbag that migrate to the base thereof can pass through the slot into said pan by the normal motion associated with carrying the purse or handbag, without permitting other objects in the purse or handbag to pass into the pan.

2. The coin separator tray according to claim 1 wherein said plurality of shelves extend along the length dimension of said pan parallel to said side walls thereof.

3. Coin separator tray for a purse or handbag, wherein the purse or handbag has a base of a predetermined length and width; the coin separator tray comprising:

an elongated pan dimensioned to match the length and width of the base of the purse or handbag, and having a bottom, side walls, an end wall, and being open at another end opposite said end wall; and a coin separating cover dimensioned to fit onto the side walls of said pan, and including a plurality of elongated, generally horizontal shelves, wherein one of said shelves is spaced above another of said shelves to define a generally horizontal elongated coin slot, such that any coins in the purse or handbag that migrate to the base thereof can pass through the slot into said pan, without permitting other objects in the purse or handbag to pass into the pan;

wherein said cover has side rail portions that mate with the side walls of said pan, respectively, side shelves that extend for the length of said rail portions in the length dimension of said pan, and which extend towards one another partly across the width dimension of said pan; a central shelf that extends along the length dimension of said pan and above the two side shelves and overlapping them to define a pair of elongated coin slots; and means holding said central shelf in place above said side shelves.

4. The coin separator tray according to claim 3 wherein said central shelf has an arcuate profile, such that coins resting on it will migrate towards one of said side shelves.

5. The coin separator tray according to claim 4 wherein said side shelves are angled downward at the associated one of said coin slots.

6. The coin separator tray according to claim 3 wherein said means holding the central shelf includes a plurality of transverse members extending between said side rail members above said central shelf, and respective gussets each attached to said central shelf and to an associated one of said transverse members.

7. The coin separator tray according to claim 6 wherein each of said transverse members includes a magnet.

8. The coin separator tray according to claim 3 wherein said tray has a pair of upper walls that extend upward from the side walls of the tray, and each of which meet to form an elongated recess with the associated side wall, with each said recess being adapted to receive an associated one of said side rail portions therein.

9. The coin separator tray according to claim 1 wherein said cover has first and second side shelves that overlap one another at a position midway between the side walls to define said coin slot opening.

10. The coin separator tray according to claim 9 wherein said first and second side shelves slope downward from said side walls towards said coin slot opening.

11. A purse or handbag which includes at least a pair of sides, first and second end walls, and a base, the base having a predetermined length and width, and one of said end walls having a flap at said base which can be opened and closed; and a coin separator tray positioned within the purse or handbag at said base, the coin separator tray including an elongated pan dimensioned to match the length and width of said base, and having a bottom, side walls, and being open at one end, said one end being positioned at said one of the end walls of the purse or handbag at which said flap is located; and a coin separating cover dimensioned to fit onto the side walls of said pan, and including a plurality of elongated generally horizontal shelves, wherein one of said shelves is spaced above and overlapping at least one other of said shelves and held apart therefrom to define a generally horizontal elongated open gap to serve as a coin slot opening, such that coins in the purse or handbag that migrate to the base of the purse or handbag can pass through the coin slot opening into said pan by the normal motion associated with carrying the purse or handbag without permitting other objects in the purse or handbag to pass into the pan, and such that coins in the pan can be accessed by opening the flap and tipping the purse or handbag.

12. The purse or handbag according to claim 11 wherein said flap includes a hinge along a bottom edge, a closure at an upper edge, and accordion fold members joining side edges thereof to the associated end wall of the purse of handbag.

13. The purse of handbag according to claim 11 wherein said coin separator tray includes a plurality of magnetic members above said shelves to attract ferrous objects in the purse or handbag, but allow non-ferrous metal coins to pass to said coin slot opening.

* * * * *